US006220306B1

(12) United States Patent
Omura et al.

(10) Patent No.: US 6,220,306 B1
(45) Date of Patent: Apr. 24, 2001

(54) LOW CARBON MARTENSITE STAINLESS STEEL PLATE

(76) Inventors: Tomohiko Omura, 33-1-106, Tadeharacho, Takano, Sakyo-ku, Kyoto-shi, Kyoto, 608-8101 (JP); Takahiro Kushida, 4-1-603, Ohamacho 2-chome, Amagasaki-shi, Hyogo, 661-0022 (JP)

( * ) Notice: Subject to any disclaimer, the term of this patent is extended or adjusted under 35 U.S.C. 154(b) by 0 days.

(21) Appl. No.: 09/447,269

(22) Filed: Nov. 23, 1999

(30) Foreign Application Priority Data

Nov. 30, 1998 (JP) ..... 10-339048

(51) Int. Cl.[7] ..... F16L 9/00; C21D 8/10

(52) U.S. Cl. ..... 138/177; 138/171; 148/519; 148/590

(58) Field of Search ..... 138/177, 171; 148/519, 521, 590, 592

(56) References Cited

U.S. PATENT DOCUMENTS

| | | | |
|---|---|---|---|
| 4,090,813 | 5/1978 | Minato et al. | 416/184 |
| 5,035,579 | 7/1991 | Yada et al. | 416/241 |
| 5,601,411 | 2/1997 | Usami et al. | 416/241 |

FOREIGN PATENT DOCUMENTS

| | | |
|---|---|---|
| 0774520 | 5/1997 | (EP) . |
| 63-278688 | 11/1988 | (JP) . |
| 63-278689 | 11/1988 | (JP) . |
| 63-278690 | 11/1988 | (JP) . |
| 4-191319 | 7/1992 | (JP) . |
| 4-191320 | 7/1992 | (JP) . |
| 9-164425 | 6/1997 | (JP) . |
| WO 96/38597 | 12/1996 | (WO) . |

*Primary Examiner*—Patrick Brinson

(57) ABSTRACT

A hot rolled martensite stainless steel plate which is excellent in formability and corrosion resistance has a chemical composition comprising, by mass %, 0.05% or less carbon, 10 to 15% chromium, 0 to 3% molybdenum, 0 to 0.75% titanium, and 1 to 8% nickel, with the balance being iron and impurities, and has a yield stress of 110 ksi (758 MPa) or less and a specific amount of austenitic phase according to the plate thickness.

9 Claims, No Drawings

LOW CARBON MARTENSITE STAINLESS STEEL PLATE

This application claims priority under 35U.S.C. §§119 and/or 365 to JP10-339048 filed in Japan on Nov. 30th, 1998, the entire content of which is herein incorporated by reference.

BACKGROUND OF THE INVENTION

The present invention relates to a hot rolled plate of low carbon martensite stainless steel having excellent formability and corrosion resistance, which is suitable to be used as material for welded pipes such as line pipes, oil casing and tubing goods or pipes for petrochemical facilities, as well as a manufacturing process of the same, and a welded pipe made thereof.

A low carbon martensite stainless steel has been recently developed as materials for an oil well. Such a low carbon martensite stainless steel is relatively inexpensive as it has a less content of expensive elements such as chromium than a duplex stainless steel, and moreover shows an excellent corrosion resistance when it is used in a wet environment containing carbonic dioxide or mixture of carbonic dioxide and a very small amount of hydrogen sulfide gas. Since the martensite stainless steel is low in carbon contents, it has an excellent weldability, and thus suitable for a line pipe assuming a circumferential welding by gas tungsten arc welding (referred to as GTAW hereinafter) or gas metal arc welding (referred to as GMAW hereinafter).

The steel pipes made of a low carbon martensite stainless steel have been conventionally manufactured mainly for a seamless pipe. However, a demand for seamless pipes of 10 mm or less in thickness, which are difficult to manufacture, has been increased in recent years.

Actually there is very few instances where a welded pipe which made of a low carbon martensite stainless steel has been put in practical use. In Japanese Patent Application Laid-Open (JP-A) Nos. 4-191319 and 4-191320, however, a welding process has been proposed in which a material coil is formed into a pipe shape and the butt portions thereof, are welded by electric resistance welding (referred to as ERW hereinafter). Additionally, in a small diameter pipe, butt welding effected by GTAW or plasma arc welding (referred to as PAW hereinafter) has also been studied.

Furthermore, as a new welding method which has been developed recently there is a laser welding-pipe making method. As examples where this method is applied for manufacturing a small diameter pipe, there are Japanese Patent Application Laid-Open (JP-A) Nos. 63-278688 in which an austenite stainless steel is used as a material steel, Japanese Patent Application Laid-Open (JP-A) Nos. 63-278689 in which a ferrite stainless steel is used as a material steel, and Japanese Patent Application Laid-Open (JP-A) Nos. 63-278690 in which an alloy containing molybdenum is used as a material steel. In these examples, it has been proposed that, after a pipe is manufactured by laser welding, a welded seam portion thereof is subject to a post weld heat treatment, so that a mechanical property of the welded metal is restored and excellent performance thereof is achieved.

In addition, butt welding using a laser oscillator with a larger power has been developed recently. In Japanese Patent Application Laid-Open (JP-A) Nos. 9-164425, a process has been proposed in which a pipe is manufactured by butt laser welding, and then the manufactured pipe is subject to an adequate post weld heat treatment at its portion near the welded seam portion so that excellent corrosion resistance can be obtained.

In recent years, a poor formability when a hot rolled plate of a low carbon martensite stainless steel is used as a material steel to be formed and welded in a pipe shape has been apparent as a significant problem. When a thin steel plate having a high strength is formed in a pipe shape, an edge wave defect estimated as a buckling phenomenon due to compression stress acting in a longitudinal direction of the pipe occurs at butted end faces, thereby resulting in a poor butt welding. Also, a thick steel plate of not less than 10 mm in thickness is used, forming or production itself becomes very difficult, and a mechanical load to a production facility such as a production roll is increased.

This phenomenon has been considered to occur mainly because a steel plate is strengthen excessively due to solution hardening of alloy elements such as nickel or molybdenum in martensite structure and due to residual strain in a hot rolled coil. In particular, a steel plate which is hot rolled often has a yield stress (YS) of higher than 110 ksi (758 Mpa), thereby making it very hard to be softened even when it is annealed or tempered only in an ordinary manner, unlike a low alloy steel. In the present situation, welding is performed without any established solution to this problem.

Currently, a strength required for a line pipe is mainly 80 ksi class which is in a range of 80 to 95 ksi (551 to 654 Mpa) in yield stress (YS), and the line pipe need not have an unnecessarily high strength. If the strength of a line pipe is excessively high, corrosion resistance such as sulfide stress cracking (referred to as SSC hereinafter) in wet environment containing hydrogen sulfide or mechanical properties such as toughness deteriorate in many cases.

An object of the present invention is to provide a hot rolled plate of low carbon martensite stainless steel which is suppressed from being excessively strengthened, and still is excellent in formability and corrosion resistance suitable as a material for a welded pipe, as well as a manufacturing process of the same, and a welded pipe made thereof.

SUMMARY OF THE INVENTION

The present invention is proposed to provide a hot rolled plate of a low carbon martensite stainless steel which is excellent in formability and corrosion resistance as described below, as well as a manufacturing process of the same and a welded pipe made thereof.

The steel plate of the present invention has a chemical composition comprising, by mass %, 0.05% or less carbon, 1% or less silicon, 5% or less manganese, 0.04% or less phosphorus, 0.01% or less sulfur, 10 to 15% chromium, 0 to 3% molybdenum, 0 to 0.1% aluminum, 0 to 0.75% titanium, 1 to 8% nickel, with the balance being iron and impurities. The steel plate has a yield stress (YS) of 110 ksi (758 MPa) or less, and contains, by volume %, 1% or more of austenite phase, further satisfying the following formulas (1) or (2):

In case of t<10

$$\gamma \geqq 2\times Mo \quad (1)$$

in case of t>10

$$\gamma \geqq 2\times Mo+(t-10) \quad (2)$$

where t represents a thickness (mm) of the hot rolled plate, γ represents amount of austenite phase (by volume %) and Mo represents molybdenum content (by mass %) in the steel.

The hot rolled plate of the present invention is manufactured by the following steps: hot rolling a steel into a plate having a chemical composition comprising, by mass %, 0.05% or less carbon, 1% or less silicon, 5% or less manganese, 0.04% or less phosphorus, 0.01% or less sulfur, 10 to 15% chromium, 0 to 3% molybdenum, 0 to 0.1% aluminum, 0 to 0.75% titanium, 1 to 8% nickel, with the balance being iron and impurities; and heat treating at a temperature of 600° C. or above and not higher than T° C. calculated by the following formula (3) for not less than 5 minutes, $$T=900-50\times Mo \quad (3)$$

where Mo represents molybdenum content (by mass %) in the steel.

The welded pipe of the present invention is a pipe in which the above described hot rolled plate of low carbon martensite stainless steel is formed into a pipe shape and butted portions thereof are welded and jointed.

DETAILED DESCRIPTION OF THE INVENTION

The present invention has been completed on the basis of the following findings. Inventors of the present invention have made intensive examinations and analysis about various factors which affect to the formability of a low carbon martensite stainless steel, and found out the following findings.

Precipitating a predetermined amount of austenitic phase into a martensite structure, which is a base material, is extremely effective for suppression from being excessively strengthened and improvement of formability. The reason thereof is that austenitic phase is relatively soft and has a good formability. Such effect is particularly great for a plate having YS of 110 ksi (758 MPa) or less. Moreover, such austenitic phase is less sensitive to SSC, excellent in a mechanical property such as toughness, and thus prevents a material performance from deteriorating, unlike a soft ferrite phase which is precipitated when the contents of chromium or molybdenum increase.

Volume fraction of austenitic phase required to sufficiently improve a formability greatly depends on the amount of molybdenum added for the purpose of improving SSC resistance in the wet environment containing hydrogen sulfide. In order words, the greater the amount of molybdenum is contained, the more deterioration of formability occurs due to solution hardening of molybdenum, and therefore the corresponding amount of the austenitic phase has to be precipitated to offset it. In addition, the steel of a greater thickness requires more formability, and thus more austenitic phase has to be precipitated.

More particularly, when a molybdenum content, thickness of the plate and volume fraction of austenitic phase are represented by Mo (%), t (mm) and γ (%) respectively, if the amount of precipitated austenitic phase is 1% or more and satisfies following formula (1) in case of $t \leqq 10$, or formula (2) in case of $t>10$, the formability is improved. Furthermore corrosion resistance can also be obtained.

$$\gamma \geqq 2\times Mo \quad (1)$$

$$\gamma \geqq 2\times Mo+(t-10) \quad (2)$$

The amount of austenitic phase which satisfies the above formulas (1) or (2) can be obtained by heat treating a hot rolled plate having the chemical composition described above at a temperature of 600° C. or above and not higher than T° C. calculated by the following formula (3) for a duration of not less than 5 minutes.

$$T=900-50\times Mo \quad (3)$$

where Mo represents molybdenum content (by mass %) in the steel.

For a low carbon martensite stainless steel, if the steel is positively subject to a heat treatment such as annealing and tempering aggressively in a duplex phase area at $A_{c1}$ transformation temperature or higher, a large amount of austenitic phase can be precipitated, thereby improving the formability.

If the heat treatment temperature is excessively high, the precipitated austenitic phase is re-quenched, which result in reducing an amount of austenitic phase precipitated. However, if the heat treatment temperature is lower than T(° C.) calculated by the formula (3), a sufficient precipitation amount of austenitic phase satisfying the above formulas (1) and (2) can be obtained.

Hereinafter, each requirement of the present invention will be described into details. It should be noted that content of respective elements is represented by mass % hereinafter.

Chemical Composition

Carbon

If the carbon content exceeds 0.05%, the steel suffers from a notable hardening at a heat affected zone (referred to as HAZ hereinafter) during the welding process, thereby deteriorating SSC resistance. Therefore the carbon content is determined to be 0.05% or less. Preferably, it is 0.03%. In view of circumferential welding, the lower carbon content is better.

Silicon

Silicon is not necessarily added, but it is preferable to add 0.05% or more for deoxidization of steel in the absence of any other deoxidiser such as aluminium. However, addition of more than 1.0% of silicon reduces a strength of grain boundary, thereby deteriorating SSC resistance. Therefore, the silicon content, if added, is preferably limited to 1.0% at maximum.

Manganese

Manganese is not necessarily added, but it is preferable to add 0.05% or more in order to improve hot workability of the steel. Manganese also has an effect of suppressing precipitation of ferrite phase in the base metal and increasing fraction of martensitic phase. However its addition of more than 5.0% reduces a strength in grain boundary or makes the steel being liable to solve in the environment containing hydrogen sulfide, thus deteriorating SSC resistance. Therefore, the manganese content, if added, is preferably limited to 5.0% at maximum.

Phosphorus

Phosphorus is contained in the steel as one of impurities and causes segregation in grain boundary, thereby deteriorating SSC resistance. Particularly, if the phosphorus content exceeds 0.04%, SSC resistance is markedly deteriorated. Therefore, the phosphorus content is determined to be 0.04% or less. It is preferable that the phosphorus content is as low as possible in order to improve SSC resistance.

Sulfur

Sulfur is also contained in the steel as one of impurities, and causes segregation in grain boundary as well as generates sulfuric inclusions drived from sulfur, thereby deteriorating SSC resistance. Particularly, if the sulfur content exceeds 0.01%, SSC resistance is markedly deteriorated. Therefore, the sulfur content is determined to be 0.01% or less. It is preferable that the sulfur content is as low as possible in order to improve SSC resistance.

Chromium

Chromium is an element which enhances corrosion resistance against a carbonic dioxide. In order to obtain this effect, chromium has to be contained 10% or more in the steel. On the contrary, an excess chromium content of more than 15% leads to an increase of material cost, which result in uneconomical manufacturing. Furthermore, an excessive chromium content encourages precipitation of ferrite phase, reduces the effective amount of chromium in the matrix, and also triggers SSC as the ferrite itself is relatively soft. Therefore, the chromium content is determined to be 10 to 15%, preferably 11 to 14%.

Aluminium

Aluminium is not necessarily added but it is preferable to add at least about 0.005% in the absence of any other deoxidiser. However, aluminium content of more than 0.1% increases the amount of coarse aluminum inclusions, which deteriorates SSC resistance. Therefore, the aluminium content, if added, is determined to be 0.1%. Aluminium mentioned in this specification means soluble aluminum (sol. Al).

Titanium

Titanium is not necessarily added, but it advantageously fixes nitrogen, one of impurities contained in the steel, into TiN. The titanium content, if added, is preferably 0.01% or more. In addition to fixing nitrogen, titanium also becomes a carbide and traps carbon, thereby suppressing HAZ from hardening during circumferential welding. If the titanium content exceeds 0.75%, however, it deteriorates workability, and carbon nitride of titanium itself triggers SSC. Therefore, the titanium content, if added, is preferably 0.75% at maximum.

Nickel

Nickel has an effect of suppressing the precipitation of ferrite phase and thereby increasing a fraction of martensitic phase. To achieve this effect, the nickel content has to be 1% or more. If nickel content exceeds 8.0%, however, it reduces formability due to solution hardening. Therefore, the nickel content is determined to be 1 to 8%.

Molybdenum

Molybdenum is not necessarily added, but it enhances pitting corrosion resistance as well as SSC resistance in the wet environment containing hydrogen sulfide. The molybdenum content, if added, is preferably 0.1% or more. If the molybdenum content exceeds 3.0%, however, it encourages precipitation of ferrite phase, and reduces the effective amount of molybdenum in the matrix, which in turn triggers SSC as the ferrite itself is relatively soft, and also leads to an increase of material cost and result in uneconomical manufacturing. Therefore, the molybdenum content, if added, is preferably limited to 3% at maximum.

Microstructure

In order to impart an excellent formability to a plate having the above chemical composition, a yield stress (YS ) thereof has to be 110 ksi or less. Even though YS is 110 ksi or less, the formability is greatly affected not only by molybdenum content in the steel but also by the thickness of the plate. Therefore, in order to obtain a desired formability, when a molybdenum content, thickness of the plate and volume fraction of austinitic phase are represented by Mo (%), t (mm) and γ (%), respectively, γ is necessary to be 1% or more and satisfy the said formula (1) or (2).

This is because, if austinitic phase is not precipitated in this amount, it is impossible to obtain a desired formability, thereby failing an excellent forming of plate into a pipe shape during forming process. More particularly, in the case of thin plate (t≦10 mm) with a high strength, the above-mentioned edge wave occurs on the butt portions of the hot rolled plate during the forming process, thereby disabling an adequate butt welding. On the other hand, in case of thick plate (t>10 mm ) an ordinary type of rolling and forming machine itself may be damaged, thus resulting in failure of forming process.

With volume fraction γ (%) of austenitic phase being lower than 1%, the plate is liable to suffer from edge wave, thereby deteriorating formability. Therefore, the volume fraction has to be 1% or more.

Above-mentioned volume fraction γ (%) of austenitic phase is obtained by the following procedures.

An X ray diffraction analysis is used to measure the amount of austenite. By the X ray diffraction analysis using Co—Kα as X ray source, an intensity ratio of {211} diffraction ray in martensitic phase and {220} diffraction ray in austenitic phase is measured at a section of a plate. Measurement is carried out at three sections and these measured values are averaged. The ratio of austenitic phase to the combined amount of martensitic phase and austenitic phase is calculated, and using this value as volume faction. Nonetheless, the intensity of diffraction ray between austenitic phase and martensitic phase differs each other, and also difference in property exists in each measurement instruments. Therefore commercially available standard samples (prepared by Rigaku Denki Kogyo) in which element phases are mixed at predetermined ratios are used to make correction of intensity.

Heat Treatment

As for the manufacturing process to precipitate a desired amount of austenitic phase which satisfies the above described formula (1) or (2), it is necessary that a plate having the above chemical composition is subject to a heat treatment at a temperature of 600° C. or above and not higher than T (° C.) calculated by the above formula (3) for not less than 5 minutes in a sustained manner. If the heating temperature is below 600° C., it is too low to precipitate a disired amount of austenitic phase. On the contrary, if the heating temperature exceeds T (° C.), the precipitated austenitic phase transforms into martensitic phase, which adversely increases a strength thereof, thereby deteriorating formability.

The reason that the upper limit of heating temperature was determined to be value T (° C.) calculated by the above formula (3) is that the more molybdenum is contained the more effective quenching becomes, and also the upper limit of heating temperature is changed dominantly by the molybdenum content.

Moreover, if duration of heating is less than 5 minutes, an uniform heat treatment can not be carried out, which occasionally leads to insufficient precipitation of austenitic phase. It should be noted that there is no upper limit of heating duration, and therefore it may be 30 to 60 minutes equivalent to tempering, or 20 to 30 hours of annealing, depending on the objective and costs.

Heating temperature need not to be kept constant, and it can be changed continuously or stepwise as far as it remains within the range described above. Also the method of cooling after heat treatment is not specifically limited, and it may be cooled with water, oil or in the atmospheric air. From the viewpoint of cost, it is preferable to cool in a furnace or in the atmospheric air.

The above-mentioned heat treatment may be carried out after the plate is hot-rolled, or during a coiling process just after hot-rolling. In the later case, the plate may be additionally heated and sustained for not less than 5 minutes in the above mentioned temperature range. Alternatively, for the purpose of causing solution of carbides or inter-metallic compounds, after solution heat treatment of heating at a temperature of 900° C. or above and water-cooling the plate, the above-mentioned heat treatment may be carried out for tempering.

Further, during a slow cooling process, for instance, cooling in a furnace after heating at a temperature of 900° C. or above, the plate may be sustained at the above temperature range for not less than 5 minutes for annealing. Namely, the purpose of such heat treatment can be achieved as far as the plate is eventually kept heating for not less than 5 minutes at the above mentioned temperature range. This treatment enables austenitic phase to precipitate to the amount that satisfies the above-mentioned formula (1) or (2).

The above-described hot rolled plate of a low carbon martensite stainless steel according the present invention is particularly suitable as a material for welded pipe. There is no specific restriction for the manufacturing process of the welded pipe, and any manufacturing process may be used as far as the performance of welded portions can be assured. For instance, arc welding method, which is represented by GTAW method, may be used, or ERW method may be used from the viewpoint of manufacturing cost reduction. Alternatively, laser welding may be used to achieve both assured quality of welded portions and high-speed welding at low cost.

Compositional and structural characteristics of the welded portion by the above welding methods are as follows. Arc welding generally uses welding material which has a different chemical composition from that of the base material, and therefore the composition of resultant welded portion differs from that of the base material. In case of ERW, metal flow due to jointing compression (upsetting) is observed. In case of laser welding, neither compositional difference of the welded nor metal flow due to jointing compression (upsetting) are observed.

In any of those methods, the hot rolled plate is firstly formed into a pipe shape by roll mill including a series of production rolls, and the opposite edges of the plate are butted against each other by suitable means such as squeezed rolls, and this butt part is welded to joint. For faster manufacturing of pipe, the plate may be preheated by an induction heating coil of pipe shape which are used for ERW electric and enables a partial area heating or by an electric resistance heating using a contact chip before welding is carried out.

Furthermore the post weld heat treatment may be carried out in order to restore the structure of welded parts after welding. Such restoration procedure may be achieved by exerting a partial heating on part adjacent to the welded portion via electric resistance heating, or by exerting a heat treatment on the welded pipe as a whole by a batch type or continuous type furnace.

EXAMPLE

Steel pieces made of 20 kinds of marttensite stainless steel which has a chemical composition shown in Table 1 were prepared.

TABLE 1

| | | Chemical composition (by mass %) | | | | | | | | | |
|---|---|---|---|---|---|---|---|---|---|---|---|
| Remarks | Type of steel | C | Si | Mn | P | S | Cr | Mo | Al | Ti | Ni |
| Inventive example | A | 0.005 | 0.43 | 0.50 | 0.018 | 0.0016 | 10.5 | — | 0.046 | 0.031 | 4.03 |
| | B | 0.008 | 0.45 | 3.89 | 0.017 | 0.0050 | 11.6 | 0.51 | 0.029 | 0.095 | 5.03 |
| | C | 0.022 | 0.25 | 0.95 | 0.031 | 0.0012 | 12.3 | 0.76 | 0.048 | 0.031 | 5.10 |
| | D | 0.005 | 0.43 | 0.97 | 0.011 | 0.0028 | 12.6 | 0.98 | 0.030 | 0.032 | 6.05 |
| | E | 0.009 | 0.44 | 0.51 | 0.019 | 0.0029 | 12.4 | 1.29 | 0.045 | 0.035 | 5.04 |
| | F | 0.008 | 0.24 | 1.92 | 0.017 | 0.0027 | 12.5 | 1.95 | 0.048 | 0.029 | 6.12 |
| | G | 0.009 | 0.45 | 0.51 | 0.022 | 0.0026 | 12.6 | 2.53 | 0.095 | — | 7.12 |
| | H | 0.025 | 0.20 | 0.53 | 0.030 | 0.0017 | 14.2 | 2.92 | 0.049 | 0.033 | 7.06 |
| Comparative example | I | *0.098 | 0.48 | 0.48 | 0.018 | 0.0022 | 12.6 | 0.51 | 0.034 | 0.035 | 5.08 |
| | J | 0.008 | *1.42 | 0.52 | 0.015 | 0.0023 | 13.1 | 0.58 | 0.031 | 0.028 | 5.96 |
| | K | 0.009 | 0.45 | *6.02 | 0.019 | 0.0030 | 12.8 | 0.71 | 0.035 | 0.031 | 5.01 |
| | L | 0.012 | 0.51 | 0.54 | *0.087 | 0.0023 | 10.2 | 0.72 | 0.048 | 0.015 | 5.20 |
| | M | 0.009 | 0.23 | 0.96 | 0.018 | *0.0141 | 12.6 | 0.75 | 0.041 | 0.016 | 2.16 |
| | N | 0.012 | 0.49 | 0.51 | 0.021 | 0.0023 | *9.2 | 1.23 | 0.051 | 0.031 | 4.97 |
| | O | 0.019 | 0.24 | 0.49 | 0.019 | 0.0018 | *17.1 | 1.51 | 0.093 | 0.015 | 5.10 |
| | P | 0.009 | 0.48 | 0.54 | 0.022 | 0.0025 | 12.9 | *3.42 | 0.043 | 0.034 | 6.03 |
| | Q | 0.007 | 0.46 | 0.52 | 0.023 | 0.0021 | 14.0 | 1.46 | *0.152 | 0.032 | 5.98 |
| | R | 0.016 | 0.23 | 1.03 | 0.025 | 0.0015 | 13.1 | 2.08 | 0.034 | *0.848 | 6.02 |
| | S | 0.011 | 0.22 | 0.48 | 0.015 | 0.0021 | 12.6 | 2.53 | 0.033 | 0.034 | *0.51 |
| | T | 0.008 | 0.20 | 1.08 | 0.020 | 0.0021 | 13.1 | 2.53 | 0.031 | 0.016 | *9.78 |

Note 1: The balances are Fe and impurities.
Note 2: *indicates values which are out of the range defined in the present invention.

These steel pieces were heated up to 1250° C., and then hot-rolled to form hot rolled plates of various thickness (6.5 to 15.0 mm) as shown in Tables 2 and 3. Then these hot rolled plates were subject to heat treatment under various conditions as shown in Tables 2 and 3 and the resultant plates were examined to find volume fraction γ (%) of austenitic phase. These plates were then formed into a pipe shape by welding, and their formability was examined. The volume fraction γ (%) of austenitic phase for each plate was determined by the above-described method.

TABLE 2

| | | | | | | Heat treatment conditions | | | | | Volume fraction of austenitic phase γ (%) | | | |
|---|---|---|---|---|---|---|---|---|---|---|---|---|---|---|
| Remarks | Method of welding | Sample No. | Type of steel | Mo content in steel (%) | Thickness of steel plate t (mm) | Heating temperature (° C.) | Upper limit of temperature (° C.) | Duration of treatment (min) | Cooling method | YS (ksi) | Calculated value | Actual value | Formability | SSC resistance |
| Inventive example | ERW | 1 | A | — | 6.5 | 650 | 900 | 300 | Furnace cooling | 97 | 0.0 | 1 | ○ | ○ |
| | | 2 | B | 0.51 | 6.5 | 650 | 875 | 300 | Furnace cooling | 96 | 1.02 | 2 | ○ | ○ |
| | | 3 | C | 0.76 | 6.5 | 650 | 862 | 300 | Furnace cooling | 98 | 1.52 | 4 | ○ | ○ |
| | | 4 | D | 0.98 | 6.5 | 650 | 851 | 300 | Furnace cooling | 104 | 1.96 | 3 | ○ | ○ |
| | | 5 | E | 1.29 | 6.5 | 650 | 836 | 600 | Furnace cooling | 97 | 2.58 | 6 | ○ | ○ |
| | | 6 | F | 1.95 | 6.5 | 650 | 803 | 600 | Furnace cooling | 103 | 3.90 | 6 | ○ | ○ |
| | | 7 | G | 2.53 | 6.5 | 650 | 774 | 1200 | Furnace cooling | 106 | 5.06 | 11 | ○ | ○ |
| | | 8 | H | 2.92 | 6.5 | 650 | 749 | 1200 | Furnace cooling | 104 | 5.84 | 12 | ○ | ○ |
| | Laser | 9 | A | — | 9.5 | 750 | 900 | 15 | Furnace cooling | 98 | 0.0 | 1 | ○ | ○ |
| | | 10 | B | 0.51 | 9.5 | 750 | 875 | 15 | Furnace cooling | 98 | 1.02 | 2 | ○ | ○ |
| | | 11 | C | 0.76 | 9.5 | 750 | 862 | 15 | Furnace cooling | 97 | 1.52 | 2 | ○ | ○ |
| | | 12 | D | 0.98 | 9.5 | 750 | 851 | 15 | Furnace cooling | 101 | 1.96 | 6 | ○ | ○ |
| | | 13 | E | 1.29 | 9.5 | 650 | 836 | 40 | Atmospheric cooling | 102 | 2.58 | 8 | ○ | ○ |
| | | 14 | F | 1.95 | 9.5 | 650 | 803 | 40 | Atmospheric cooling | 103 | 3.90 | 10 | ○ | ○ |
| | | 15 | G | 2.53 | 9.5 | 650 | 774 | 40 | Atmospheric cooling | 105 | 5.06 | 11 | ○ | ○ |
| | | 16 | H | 2.92 | 9.5 | 650 | 749 | 40 | Atmospheric cooling | 101 | 5.84 | 11 | ○ | ○ |
| | | 17 | A | — | 12.0 | 800 | 900 | 40 | Atmospheric cooling | 96 | 2.0 | 3 | ○ | ○ |
| | | 18 | B | 0.51 | 12.0 | 800 | 875 | 40 | Atmospheric cooling | 93 | 3.02 | 5 | ○ | ○ |
| | | 19 | C | 0.76 | 12.0 | 800 | 862 | 40 | Atmospheric cooling | 89 | 3.52 | 5 | ○ | ○ |
| | | 20 | D | 0.98 | 12.0 | 800 | 851 | 40 | Atmospheric cooling | 96 | 3.96 | 8 | ○ | ○ |
| | | 21 | E | 1.29 | 12.0 | 650 | 836 | 1200 | Furnace cooling | 96 | 4.58 | 10 | ○ | ○ |
| | | 22 | F | 1.95 | 12.0 | 650 | 803 | 1200 | Furnace cooling | 93 | 5.90 | 11 | ○ | ○ |
| | | 23 | G | 2.53 | 12.0 | 650 | 774 | 1200 | Furnace cooling | 98 | 7.06 | 13 | ○ | ○ |
| | | 24 | H | 2.92 | 12.0 | 650 | 749 | 1200 | Furnace cooling | 95 | 7.84 | 19 | ○ | ○ |
| | | 25 | E | 1.29 | 15.0 | 650 | 836 | 1200 | Furnace cooling | 106 | 7.58 | 12 | ○ | ○ |
| | | 26 | F | 1.95 | 15.0 | 650 | 803 | 1200 | Furnace cooling | 103 | 8.90 | 13 | ○ | ○ |
| | | 27 | G | 2.53 | 15.0 | 650 | 774 | 1200 | Furnace cooling | 105 | 10.06 | 15 | ○ | ○ |
| | | 28 | H | 2.92 | 15.0 | 650 | 749 | 1200 | Furnace cooling | 101 | 10.84 | 20 | ○ | ○ |

Note 1: Upper limit of temperature in 'Heat treatment conditions' is calculated by formula (900 − 50 × Mo).
Note 2: Calculation value in 'Volume fraction of austenitic phase' is given by the following formulas (1) and (2); (1) 2 × Mo [in case of t ≦ 10] (2) 2 × Mo + (t − 10) [in case of t > 10]

TABLE 3

| | | | | | | Heat treatment conditions | | | | | Volume fraction of austenitic phase γ (%) | | | |
|---|---|---|---|---|---|---|---|---|---|---|---|---|---|---|
| Remarks | Method of welding | Sample No. | Type of steel | Mo content in steel (%) | Thickness of steel plate t (mm) | Heating temperature (° C.) | Upper limit of temperature (° C.) | Duration of treatment (min) | Cooling method | YS (ksi) | Calculated value | Actual value | Formability | SSC resistance |
| Inventive example | ERW | 29 | A | — | 6.5 | — | 900 | — | — | *115 | 0.0 | *0 | X | X |
| | | 30 | B | 0.51 | 6.5 | — | 875 | — | — | *113 | 1.02 | *1 | X | X |
| | | 31 | C | 0.76 | 6.5 | *550 | 862 | 1200 | Furnace cooling | *116 | 1.52 | *1 | X | X |
| | | 32 | D | 0.98 | 6.5 | *550 | 851 | 1200 | Furnace cooling | *115 | 1.96 | *1 | X | X |
| | | 33 | A | — | 9.5 | 650 | 900 | *5 | Furnace cooling | *115 | 0.0 | *0 | X | X |
| | | 34 | B | 0.51 | 9.5 | 650 | 875 | *5 | Furnace cooling | *113 | 1.02 | 2 | X | X |
| | | 35 | C | 0.76 | 9.5 | 750 | 862 | *5 | Furnace cooling | 108 | 1.52 | *1 | X | ○ |
| | | 36 | D | 0.98 | 9.5 | 750 | 851 | *5 | Furnace cooling | 105 | 1.96 | *1 | X | ○ |
| | Laser | 37 | E | 1.29 | 12.0 | *850 | 836 | 15 | Furnace cooling | 109 | 4.58 | *2 | X | ○ |
| | | 38 | F | 1.95 | 12.0 | *850 | 803 | 15 | Furnace cooling | 109 | 5.90 | *2 | X | ○ |
| | | 39 | G | 2.53 | 12.0 | *800 | 774 | 15 | Furnace cooling | 105 | 7.06 | *4 | X | ○ |
| | | 40 | H | 2.92 | 12.0 | *800 | 749 | 15 | Furnace cooling | 101 | 7.84 | *5 | X | ○ |
| | | 41 | *I | 0.51 | 6.5 | 650 | 875 | 1200 | Furnace cooling | 92 | 1.02 | 8 | ○ | X |
| | | 42 | *J | 0.58 | 6.5 | 650 | 871 | 1200 | Furnace cooling | 93 | 1.16 | 10 | ○ | X |
| | | 43 | *K | 0.71 | 6.5 | 650 | 865 | 1200 | Furnace cooling | 98 | 1.42 | 11 | ○ | X |
| | | 44 | *L | 0.72 | 6.5 | 650 | 864 | 1200 | Furnace cooling | 91 | 1.44 | 11 | ○ | X |
| | | 45 | *M | 0.75 | 6.5 | 650 | 863 | 1200 | Furnace cooling | 95 | 1.50 | 3 | ○ | X |
| | | 46 | *N | 1.23 | 6.5 | 650 | 839 | 1200 | Furnace cooling | 94 | 1.46 | 5 | ○ | X |

TABLE 3-continued

| Remarks | Method of welding | Sample No. | Type of steel | Mo content in steel (%) | Thickness of steel plate t (mm) | Heat treatment conditions: Heating temperature (° C.) | Heat treatment conditions: Upper limit of temperature (° C.) | Heat treatment conditions: Duration of treatment (min) | Cooling method | YS (ksi) | Volume fraction of austenitic phase γ (%): Calculated value | Volume fraction of austenitic phase γ (%): Actual value | Formability | SSC resistance |
|---|---|---|---|---|---|---|---|---|---|---|---|---|---|---|
| | | 47 | *O | 1.51 | 6.5 | 650 | 825 | 1200 | Furnace cooling | 99 | 3.02 | 5 | ○ | X |
| | | 48 | *P | 3.42 | 6.5 | 650 | 729 | 1200 | Furnace cooling | 91 | 6.84 | 8 | ○ | X |
| | | 49 | *Q | 1.46 | 6.5 | 650 | 827 | 1200 | Furnace cooling | 105 | 2.92 | 10 | ○ | X |
| | | 50 | *R | 2.08 | 6.5 | 650 | 796 | 1200 | Furnace cooling | 104 | 4.16 | 11 | ○ | X |
| | | 51 | *S | 2.53 | 6.5 | 650 | 774 | 1200 | Furnace cooling | 103 | 5.06 | 13 | ○ | X |
| | | 52 | *T | 2.51 | 6.5 | 650 | 775 | 1200 | Furnace cooling | 104 | 5.02 | 19 | ○ | ○ |

Note 1: Upper limit of temperature in 'Heat treatment conditions' is calculated by formula (900 − 50 × Mo).
Note 2: Calculation value in 'Volume fraction of austenitic phase' is given by the following formulas (1) and (2); (1) 2 × Mo [in case of t ≦ 10] (2) 2 × Mo + (t − 10) [in case of t > 10]
Note 3: *indicates values which are out of the range defined in the present invention.

Furthermore a test piece for testing sulfide stress cracking whose thickness of 2 mm, width of 10 mm and length of 75 mm was sampled from the resultant welded pipes at its axial direction, and the sulfide stress cracking test (SSC test) was carried out under the following conditions to examine their corrosion resistance, i.e. SSC resistance.

Method of strain control: four point bent beam test,

Applied stress: YS value of test steel,

Test solution: 5% NaCl solution containing $H_2S$ of 0.001 to 0.001 MPa and saturated with $CO_2$, pH:3.5 to 4.5(adjusted by composite addition of acetic acid and sodium acetate), and Immersion time: 336 hours It should be noted that the higher a partial pressure and the lower pH becomes, the more severe the corrosion environment becomes. Therefore SSC resistance required depends on the molybdenum content in the material. Therefore, samples whose molybdenum content of less than 0.7% was tested under the following condition (a), 0.7 to less than 1.2% under (b), 1.2 to less than 2% under (c), and 2% or more under (d).

(a) 0.001 MPa $H_2S$—pH4.5

(b) 0.001 MPa $H_2S$—pH4, (c) 0.01 MPa $H_2S$—pH4, and (d) 0.001 MPa $H_2S$—pH3.5

These conditions (a) to (d) according to the above molybdenum content are usually used to judge SSC resistance of martensite stainless steel.

Evaluation of formability is indicated as follows; those in which neither edge wave nor unwelded portion during forming process was observed is assessed as excellent "○", and those in which such phenomena was observed is assessed as poor "x". For evaluation of SSC resistance, if any cracking was not observed, it is assessed as excellent "○", and if observed it was assessed as poor "x". These results are shown in Tables 2 and 3.

As is obvious from Tables 2 and 3, the hot rolled plates (sample Nos. 1 to 28), which were made of a martensite stainless steel having the chemical composition defined in the present invention and heat treated under the conditions defined in the present invention, satisfy the volume fraction γ of austenitic phase defined in the present invention. These samples have YS of 110 ksi or less, and show excellent formability during welded-pipe making process and excellent SSC resistance.

On the contrary, among the hot rolled plates of comparative examples (sample Nos. 29 to 40) whose chemical composition is within the range defined in the present invention, but heat treatment conditions deviate from the range defined in the present invention, the samples Nos. 29 to 34 showed insufficient suppression from being excessively strengthened and YS of more than 110 ksi as well as some of them showed insufficient precipitation of austenitic phase, thus resulting in poor corrosion resistance and formability during the welded-pipe making process.

Samples Nos. 35 to 40 showed excellent corrosion resistance because they had sufficient suppression from being excessively strengthened and YS of less than 110 ksi, while they showed poor formability during the welded-pipe making process because of insufficient precipitation of austenitic phase.

Further, in case of the plates of comparative examples (sample Nos. 41 to 52) in which heat treatment conditions remain within the range defined in the present invention, but their chemical compositions deviate from the range defined in the present invention, they showed a poor result in either formability during welded-pipe making process or SSC resistance because of inferiority in those properties inherent to the element steel, although satisfying conditions of YS and volume fraction of austenitic phase.

A hot rolled plate of martensite stainless steel according to the present invention has excellent formability and corrosion resistance. Therefore, by using the plates of the present invention, a welded pipe which is excellent in quality of welded portion and in corrosion resistance can be manufactured with a high production yield. Further, by using the plates of the present invention, it is possible to manufacture a welded pipes of a thick wall, which can not be manufactured by conventional welded-pipe making facilities because of some reasons such as damaging the production rolls. The manufacturing process of the hot rolled plate according to the present invention only requires subjecting the steel plate to the predetermined teat treatment after hot rolling, thus enabling the manufacturing cost to be low.

What is claimed is:

1. A hot rolled plate of low carbon martensite stainless steel which has a chemical composition comprising, by mass %, 0.05% or less carbon, 1% or less silicon, 5% or less manganese, 0.04% or less phosphorus, 0.01% or less sulfur, 10 to 15% chromium, 0 to 3% molybdenum, 0 to 0.1% aluminum, 0 to 0.75% titanium, 1 to 8% nickel, with the balance being iron and impurities; has the yield stress of 110 ksi (758 MPa) or less; contains, by volume %, 1% or more of austenitic phase; and also satisfies the following formulas (1) or (2):

in case of $t \leqq 10$ $$\gamma \geqq 2 \times Mo \quad (1)$$

in case of $t > 10$ $$\gamma \geqq 2 \times Mo + (t - 10) \quad (2)$$

where t represents a thickness (mm) of the plate, γ represents amount of austenitic phase (by volume %) and Mo represents molybdenum content (by mass %) in the steel.

2. The hot rolled plate of low carbon martensite stainless steel according to claim 1, wherein said steel contains 0.03% or less carbon by mass.

3. The hot rolled plate of low carbon martensite stainless steel according to claim 1, wherein said steel contains 11 to 14% chromium by mass.

4. The hot rolled plate of low carbon martensite stainless steel according to claim 1, wherein said steel contains 4 to 8% nickel by mass.

5. A process of manufacturing a hot rolled plate of low carbon martensite stainless steel, comprising the steps of the following (a) and (b) or (a) and (c):

(a) hot rolling said steel into a plate;

(b) heat treating said plate at a temperature range of 600° C. or above and not higher than T° C. calculated by the following formula (3) for not less than 5 minutes;

(c) sustaining said plate at a temperature range of 600° C. or above and not higher than T° C. calculated by the following formula (3) for not less than 5 minutes during cooling process, $$T = 900 - 50 \times Mo \quad (3)$$

where Mo represents molybdenum content, by mass %, in the steel, wherein said steel has a chemical composition comprising, by mass, 0.05% or less carbon, 1% or less silicon, 5% or less manganese, 0.04% or less phosphorus, 0.01% or less sulfur, 10 to 15% chromium, 0 to 3% molybdenum, 0 to 0.1% aluminum, 0 to 0.75% titanium, 1 to 8% nickel, with the balance being iron and impurities.

6. A pipe made of a hot rolled plate of low carbon martensite stainless steel according to claim 1, wherein butted portions of said plate formed into said pipe are jointed by a welding method.

7. The pipe according to claim 6, wherein said welding method is arc welding.

8. The pipe according to claim 6, wherein said welding method is electric resistance welding.

9. The pipe according to claim 6, wherein said welding method is laser welding.

* * * * *

UNITED STATES PATENT AND TRADEMARK OFFICE

CERTIFICATE OF CORRECTION

PATENT NO. : 6,220,306 B1
DATED : April 24, 2001
INVENTOR(S) : Omura et al.

It is certified that error appears in the above-identified patent and that said Letters Patent is hereby corrected as shown below:

Title page,
Assignee is: -- Sumitomo Metal Industries, Inc.
Osaka, Japan --
Attorney, Agent, or Firm is: -- Clark and Brody --

Signed and Sealed this

Eighth Day of January, 2002

*Attest:*

*Attesting Officer*

JAMES E. ROGAN
*Director of the United States Patent and Trademark Office*